United States Patent [19]

Denney

[11] Patent Number: 4,729,137

[45] Date of Patent: Mar. 8, 1988

[54] BED CANOPY SUPPORT AND ASSEMBLY

[76] Inventor: Carmen T. Denney, 6912 Woodstream La., Seabrook, Md. 20706

[21] Appl. No.: 898,484

[22] Filed: Aug. 21, 1986

[51] Int. Cl.[4] ..... A47C 21/00

[52] U.S. Cl. ..... 5/414; 5/508; 5/512

[58] Field of Search ..... 5/97, 121, 200 R, 200 C, 5/201, 414, 503–505, 508, 512; 135/90, 106; 160/19; 248/205.2, 343

[56] References Cited

U.S. PATENT DOCUMENTS

| | | | |
|---|---|---|---|
| 3,956,784 | 5/1974 | Vargas | 5/414 |
| 3,996,987 | 12/1979 | Rodriguez | 160/19 |
| 4,169,294 | 10/1979 | Harris | 5/200 R |
| 4,414,727 | 11/1983 | Steele | 5/414 |

*Primary Examiner*—Alesander Grosz
*Assistant Examiner*—Michael F. Trettel
*Attorney, Agent, or Firm*—Donald A. Kettlestrings

[57] ABSTRACT

A bed canopy support and assembly are provided wherein the assembly is comprised of four supports fastened together in a rectangular configuration. Each support includes a channel-shaped valance support member defining upper and lower substantially parallel and opposed flanges and a connecting element extending between and at substantially right angles with the flanges, and a substantially L-shaped drapery and canopy support member integral with and projecting downwardly from and at substantially a right angle with the lower flange. Hook and loop type fastener material, such as Velcro, are provided on each support for attaching a valance drapery and canopy to the support.

12 Claims, 7 Drawing Figures

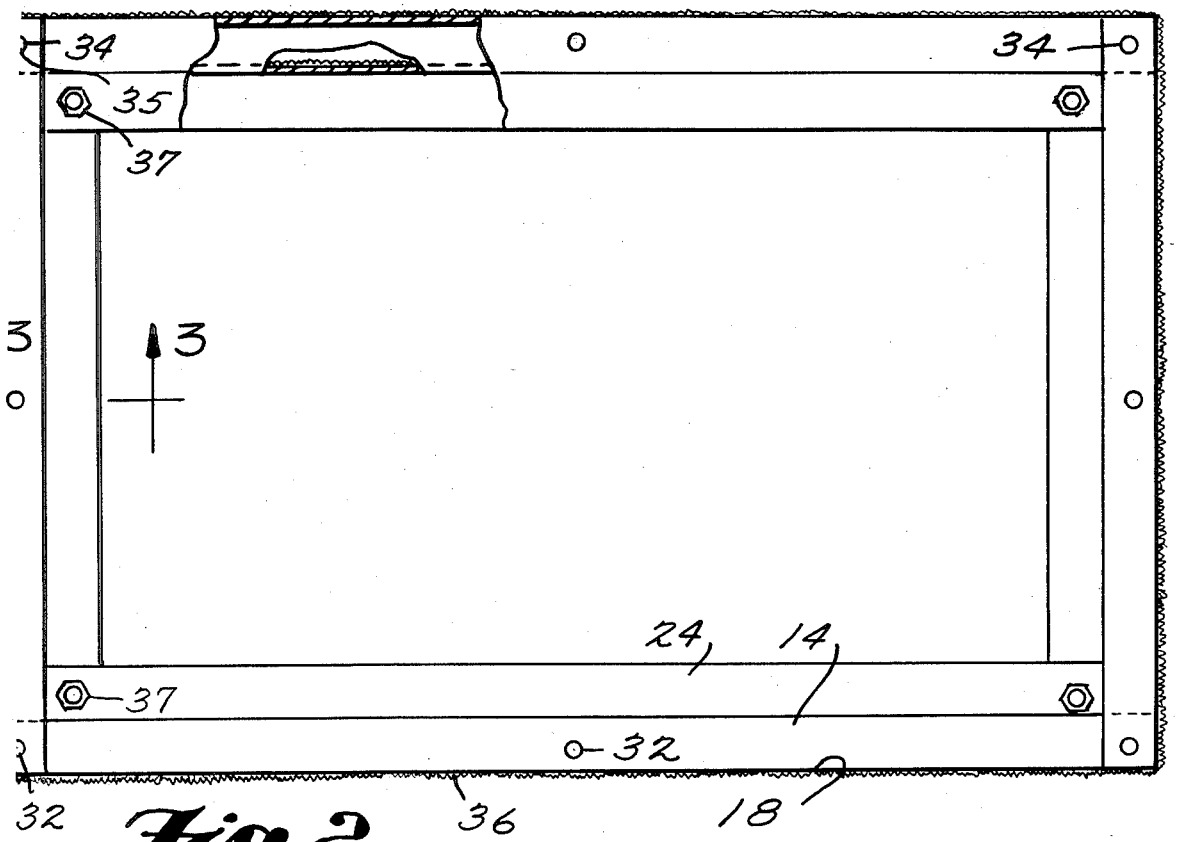
Fig. 2.
Fig. 4.
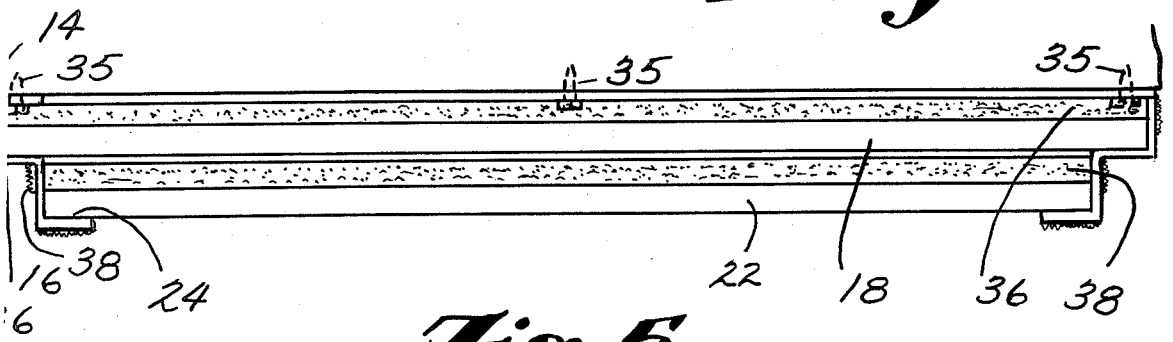
Fig. 5.
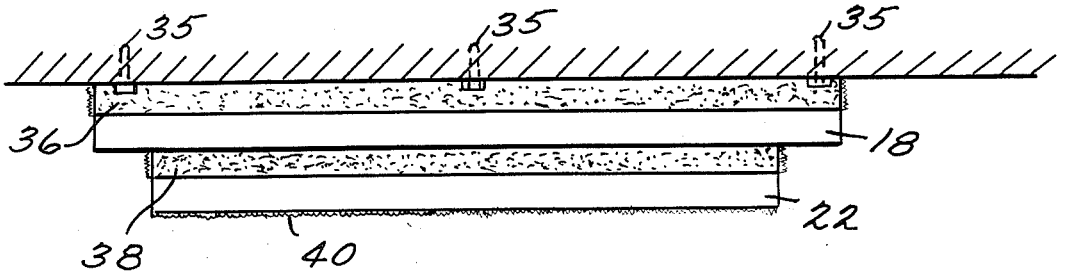

BED CANOPY SUPPORT AND ASSEMBLY

This invention relates to a structure for supporting a bed canopy and more particularly to a bed canopy support and assembly for supporting valances, draperies and a canopy over conventional single, double, queen or king size beds.

An object of the present invention is to provide a bed canopy support and assembly for supporting valances, draperies and a canopy over conventional single, double, queen or king size beds in an aesthetically pleasing manner with the supports and assembly being out of sight when the supports and assembly are completely outfitted with valances, draperies and canopy.

Another object is to provide a bed canopy support which utilizes hook and loop type fastener material, such as Velcro, as a means for attaching valances, draperies and the canopy to the support.

A further object of the invention is the provision of a bed canopy support which is light in weight and which is sturdy in construction.

Still another object is to provide bed canopy supports which can be assembled together prior to attaching the assembly to a ceiling or the like.

Yet another object of the present invention is the provision of bed canopy supports which can be simultaneously assembled together and attached to a ceiling or the like.

A still further object is to provide bed canopy supports which can be easily and quickly assembled into a bed canopy support assembly.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a bed canopy support comprising: a channel-shaped valance support member defining upper and lower substantially parallel and opposed flanges and a connecting element extending between and at substantially right angles with the flanges; a substantially L-shaped drapery and canopy support member defining a first element and a flanged element integral with and projecting at a substantially right angle from the first element, the first element integral with and projecting downwardly from and at substantially a right angle with the lower flange; first means in operative relationship with the connecting element for enabling removable attachment of a valance to the connecting element; second means in operative relationship with the first element for enabling removable attachment of a drapery or curtain to the first element; third means in operative relationship with the flange element for enabling removable attachment of a canopy to the flange element; fourth means in operative relationship with the valance support member for enabling attachment of the valance support member to a ceiling or the like; and fifth means in operative relationship with the valance support member and with the drapery and canopy support member for enabling removable attachment together of additional of the canopy supports to the canopy support to form a bed canopy support assembly.

In accordance with the invention, the length of the channel-shaped support member is greater than the length of the L-shaped support member, and the L-shaped support member is substantially centrally positioned along the length of the channel-shaped member to enable the supports to be connected together at substantially right angles with respect to each other and in abutting relationship with each other.

Preferably, strips of hook and loop type fastener material, such as Velcro strips, extend along substantially the entire length of the connecting element, the first element, and the flange element for permitting removable attachment thereto of a valance, a drapery or curtain, and a canopy, respectively.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

FIG. 2 is a fragmentary top plan view of the assembly;

FIG. 4 is a side elevation view of the assembly showing a canopy attached to the assembly but without a valance or drapery attached thereto;

FIG. 5 is an end elevation view of the assembly without a valance, drapery or canopy attached thereto;

Figure 1:
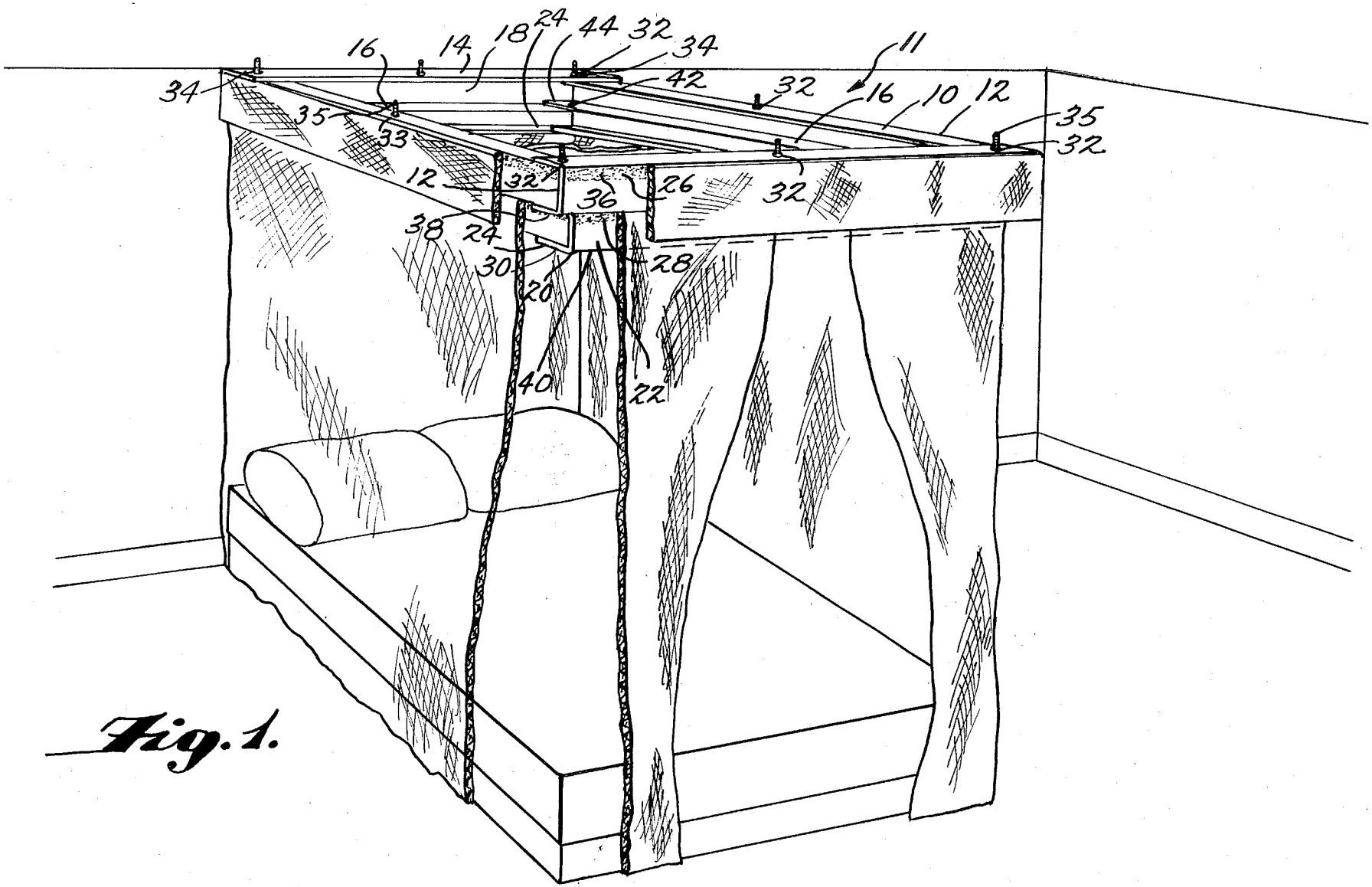
FIG. 1 is a fragmentary perspective view of four supports in accordance with this invention connected together to form an assembly which is attached to a ceiling and which is shown supporting valances, draperies and a canopy.
Figure 3:
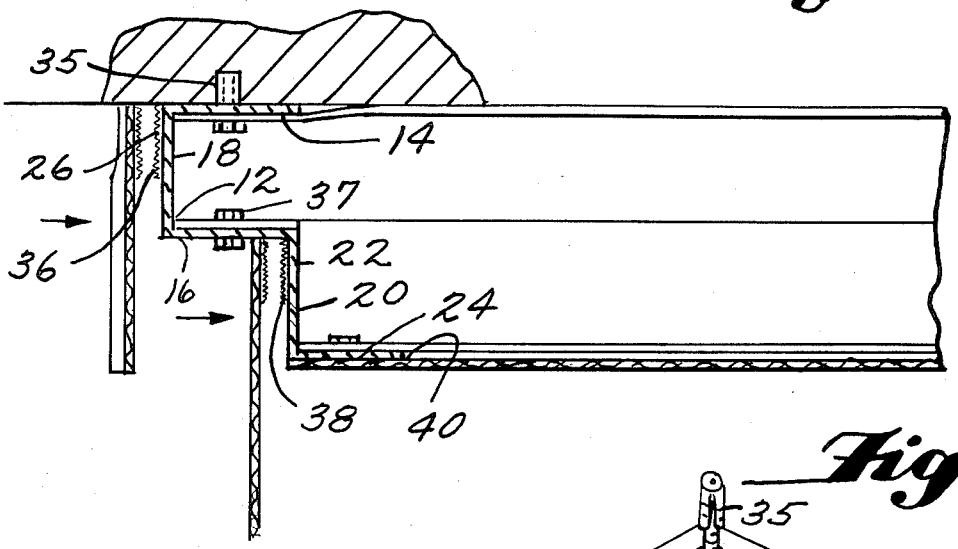
FIG. 3 is cross-sectional view of a support along the line 3—3 in FIG. 2 and looking in the direction of the arrows and showing a valance and drapery in positions to be attached to the support and showing a canopy in position on the support.
Figure 7:
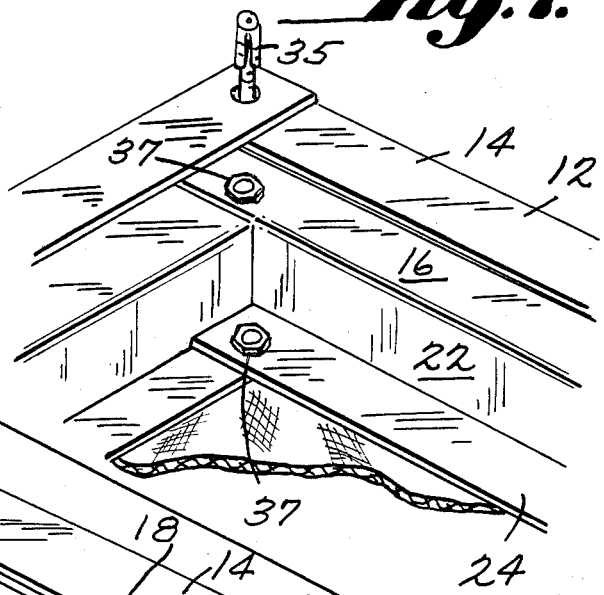
FIG. 7 is a fragmentary perspective view of two adjacent and abutting supports of the assembly and showing a canopy attached to the assembly.
Figure 6:
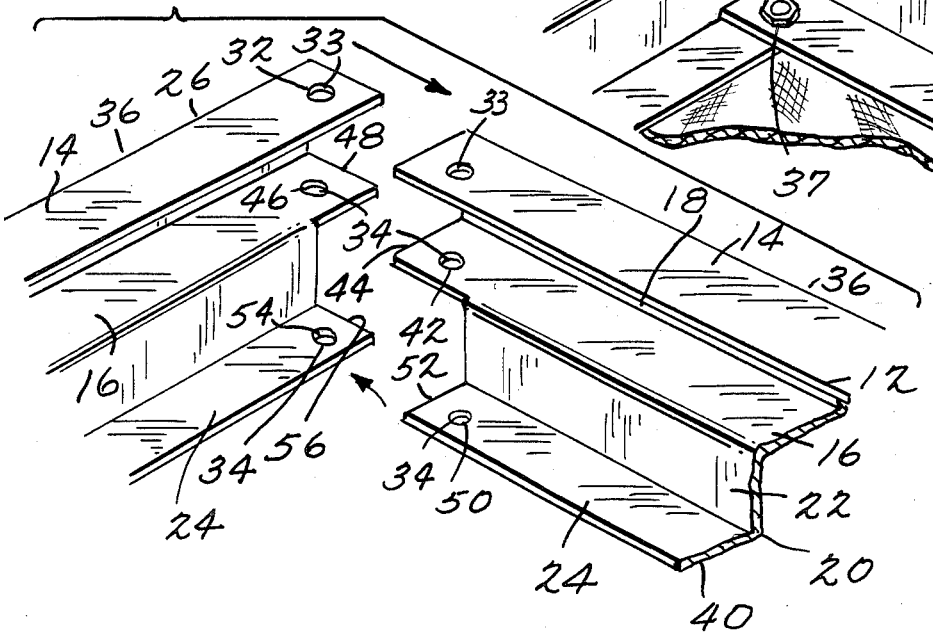
FIG. 6 is a fragmentary perspective view of two adjacent supports of the assembly prior to their attachment together.

With reference now to the drawings, wherein like reference characters designate like or corresponding parts throughout the several views, there is shown a bed canopy support 10 which includes a channel-shaped valance support member 12 which defines an upper flange 14, a lower flange 16 substantially parallel and in opposed relationship with upper flange 14, and a connecting element 18 extending between and at substantially right angles with flanges 14, 16.

Canopy support 10 further includes a substantially L-shaped drapery and canopy support member 20 which defines a first element 22 and a flange element 24 integral with and projecting at a substantially right angle from first element 22. First element 22 is integral with and projects downwardly from and at a substantially right angle with lower flange 16.

First means 26 are provided in operative relationship with connecting element 18 for enabling removable attachment of a valance to connecting element 18. Second means 28 are provided in operative relationship with first element 22 for enabling removable attachment of a drapery or curtain to first element 22. Third means 30 are similarly provided in operative relationship with flange element 24 for enabling removable attachment of a canopy or the like to flange element 24.

Fourth means 32 are provided in operative relationship with valance support member 12 for enabling attachment of the valance support member to a ceiling or the like. Fifth means 34 are provided in operative relationship with valance support member 12 and with drapery and canopy support member 20 for enabling attachment together of additional similar canopy supports to canopy support 10 to form a bed canopy support assembly.

The length of channel-shaped support member 12 is greater than the length of L-shaped member 20, and L-shaped support member 20 is substantially centrally positioned along the length of channel-shaped member 12 to enable supports 10 to be connected together at substantially right angles and in abutting relationship.

First means 26 preferably include a first strip of hook and loop type fastener material, such as Velcro, 36 attached to connecting element 18 and extending along substantially the entire length of the connecting element. Second means 28 preferably include a second strip of hook and loop type fastener material, such as Velcro, 38 attached to and extending along substantially the entire length of first element 22. Similarly, third means 30 preferably include a third strip of hook and loop type fastener material, such as Velcro 40 attached to and extending along substantially the entire length of flange element 24.

Fourth means 32 include a first plurality of holes 33 defined within upper flange 14 for receiving first conventional fastener elements 35 whereby valance support member 12 can be attached to a ceiling or the like. Fifth means 34 include a second hole 42 defined within lower flange 16 and adjacent a first end 44 thereof. Fifth means 34 further include a third hole 46 defined within lower flange 16 and adjacent a second end 48 thereof. Fifth means 34 also include a fourth hole 50 defined within flange element 24 and adjacent a first end 52 thereof, and fifth means 34 include a fifth hole 54 defined within flange element 24 and adjacent a second end 56 thereof.

When four canopy supports 10 of predetermined lengths are attached together to form a substantially rectangular bed canopy support assembly 11, supports 10 are attached together at right angles and in abutting relationship with each other by means of conventional fastener elements 37 which respectively extend through holes 42, 46, 50 and 54. Those fastener elements 35 which extend through holes 33 which are located adjacent to the ends of each support 10 act to attach support 10 to the ceiling and to attach adjacent supports to each other.

Each support 10 is preferably comprised of vinyl plastic or other durable, light-weight and strong material, and each support 10 can be manufactured to substantially identical vertical dimensions. Alternatively, predetermined opposed supports 10 in each assembly 11 can be manufactured with slightly smaller vertical dimensions than the other two opposed supports 10 within the assembly to accomodate connection of abutting supports together with flanges 14, 16 and 24 of one support positioned within the corresponding flanges of the adjacent support, as shown in FIG. 1.

Hook and loop type fastener material, such as Velcro, is the preferred means of attaching valances, draperies or curtains, and the canopy to supports 10 and to assembly 11. Such material is light in weight and permits quick and easy attachment and removal of valances, draperies or curtains, and a canopy from the supports and the support assembly. The use of hook and loop type fastener material, such as Velcro, provides an additional safety feature which may prevent damage to the assembly or ceiling and injury to a child or other person if that child or person pulls on the drapery or curtain. If hook and loop type fastener material is used, the drapery or curtain will simply be removed and will fall away from the canopy support and assembly without loosening or removing assembly 11 from the ceiling. This feature will help to avoid injury to the child that might occur if the support or assembly were pulled from the ceiling, and such a result might occur if the draperies were attached to support 10 by means of a conventional rod.

The length of canopy supports 10 can be provided to accomodate conventional single, double, queen or king size beds. Also, because of the construction of each support 10 and assembly 11, the supports and assembly are not visible when the assembly is completely outfitted with a valance, curtains and canopy. The assembly cannot be viewed by someone in the bed because the canopy screens any view of the supports and assembly. Likewise, the supports and assembly cannot be seen by someone outside of the bed area because the valance is typically considerably greater in height than the total height of each support 10. As a result, the valance screens any view of supports 10 or of assembly 11. Supports 10 and assembly 11 provide a very aesthetically pleasing decorative canopy arrangement.

Supports 10 can be assembled together before assembly 11 is installed on the ceiling as a single unit, or supports 10 can be installed on the ceiling one section at a time until assembly 11 is completed in place on the ceiling.

Hook and loop type fastener material strip 36 enables a valance having hook and loop type fastener material attached thereto to be mounted on valance support member 12. Similarly, second hook and loop type fastener material strip 38 enables draperies or curtains having with hook and loop type fastener material attached thereto to be mounted onto support member 20. Because hook and loop type fastener material strip 38 extends substantially along the length of first element 22, draperies or curtains can be fastened only to the corners of assembly 11 to achieve the illusion of a four poster bed canopy, or the draperies or curtains can be fastened wherever desired along the length of hook and loop type fastener material strip 38. Hook and loop type fastener material strip 40 extends substantially along the length of flange element 24 to enable a canopy having hook and loop type fastener material substantially around its perimeter to be attached to hook and loop type fastener material strip 40.

The invention in its broader aspects is not limited to the specific details shown and described, and departures may be made from such details without departing from the principles of the invention and without sacrificing its chief advantages.

What is claimed is:

1. A bed canopy support comprising:

a channel-shaped valance support member defining upper and lower substantially parallel and opposed flanges and a connecting element extending between and at substantially right angles with said flanges;

a substantially L-shaped drapery and canopy support member defining a first element and a flange element integral with and projecting at a substantially right angle from said first element, said first element integral with and projecting downwardly from and at substantially a right angle with said lower flange;

first means in operative relationship with said connecting element for enabling removable attachment of a valance to said connecting element;

second means in operative relationship with said first element for enabling removable attachment of a drapery or a curtain to said first element;

third means in operative relationship with said flange element for enabling removable attachment of a canopy to said flange element;

fourth means in operative relationship with said valance support member for enabling attachment of said valance support member to a ceiling or the like; and fifth means in operative relationship with said valance support member and with said drapery and canopy support member for enabling attachment together of additional of said canopy supports to said canopy support to form a bed canopy support assembly.

2. A support as in claim 1 wherein the length of said channel-shaped support member is greater than the length of said L-shaped support member, said L-shaped support member substantially centrally positioned along the length of said channel-shaped member.

3. A support as in claim 2 wherein said first means include a first hook and loop type fastener strip attached to said connecting element.

4. A support as in claim 3 wherein said first hook and loop type fastener strip extends along substantially the entire length of said connecting element.

5. A support as in claim 2 wherein said second means include a second hook and loop type fastener strip attached to said first element.

6. A support as in claim 5 wherein said second hook and loop type fastener strip extends along substantially the entire length of said first element.

7. A support as in claim 2 wherein said third means include a third hook and loop type fastener strip attached to said flange element.

8. A support as in claim 7 wherein said third hook and loop type fastener strip extends along substantially the entire length of said flange element.

9. A support as in claim 2 wherein said fourth means include a first plurality of holes defined within said upper flange for receiving first fastener elements whereby said valance support member can be attached to a ceiling or the like.

10. A support as in claim 9 wherein said fifth means include a second hole defined within said lower flange and adjacent a first end thereof, a third hole defined within said lower flange and adjacent a second end thereof, a fourth hole defined within said flange element and adjacent a first end thereof, and a fifth hole defined within said flange element and adjacent a second end thereof, whereby said second, third, fourth and fifth holes receive second fastener elements when additional of said supports are attached to said bed canopy support to form a bed canopy support assembly.

11. A support as in claim 10 comprised of vinyl plastic.

12. A bed canopy support assembly comprised of four of said supports as defined in claim 2 of predetermined lengths fastened together to form a rectangular support assembly.

* * * * *